US007443088B2

(12) United States Patent
Lykowski

(10) Patent No.: US 7,443,088 B2
(45) Date of Patent: Oct. 28, 2008

(54) COAXIAL TWIN SPARK PLUG

(75) Inventor: James D. Lykowski, Temperance, MI (US)

(73) Assignee: Federal Mogul World Wide, Inc., Southfield, MI (US)

( * ) Notice: Subject to any disclaimer, the term of this patent is extended or adjusted under 35 U.S.C. 154(b) by 861 days.

(21) Appl. No.: 10/969,492

(22) Filed: Oct. 20, 2004

(65) Prior Publication Data

US 2006/0082275 A1 Apr. 20, 2006

(51) Int. Cl.
*H01T 13/00* (2006.01)

(52) U.S. Cl. ..... 313/123; 313/141

(58) Field of Classification Search ..... 313/139–143
See application file for complete search history.

(56) References Cited

U.S. PATENT DOCUMENTS

| | | | | |
|---|---|---|---|---|
| 1,024,321 | A | | 4/1912 | Ellis |
| 1,033,449 | A | | 7/1912 | Murray |
| 1,159,911 | A | | 11/1915 | Eckhardt |
| 1,165,492 | A | | 12/1915 | Briggs |
| 1,229,193 | A | | 6/1917 | Minogue |
| 1,259,240 | A | | 3/1918 | Jeffrey |
| 1,335,797 | A | | 4/1920 | Rohde |
| 1,363,904 | A | | 12/1920 | Nicholson |
| 1,385,529 | A | | 7/1921 | Ellis |
| 1,538,517 | A | | 5/1925 | Gebhardt |
| 1,675,242 | A | | 6/1928 | Bailly |
| 2,077,711 | A | | 4/1937 | Redinger, Jr. |
| 2,122,015 | A | | 6/1938 | St. John |
| 2,487,319 | A | | 11/1949 | Ellis, Jr. |
| 2,747,122 | A | | 5/1956 | Booth, Sr. |
| 4,308,487 | A | | 12/1981 | Feaster |
| 4,914,344 | A | * | 4/1990 | Watanabe et al. ..... 313/141 |
| 5,791,320 | A | | 8/1998 | Haban |

FOREIGN PATENT DOCUMENTS

| | | |
|---|---|---|
| JP | 05326107 | 10/1993 |

* cited by examiner

*Primary Examiner*—Joseph L Williams
(74) *Attorney, Agent, or Firm*—Robert L. Stearns; Dickinson Wright PLLC

(57) ABSTRACT

A spark plug having a pair of independent spark gaps includes a shell, inner and outer insulators, a cylindrical electrode assembly, a center wire assembly, and a pair of ground electrodes. The cylindrical electrode assembly is generally located between the two insulators and delivers a first high voltage ignition pulse to a first spark gap. The center wire assembly is located in an axial bore of the inner insulator and delivers a second high voltage ignition pulse to a second spark gap. The two insulators and two electrode assemblies are all coaxially aligned within the shell so that both insulators can be rotationally symmetrical. The first spark gap is radially oriented while the second spark gap is axially oriented, and the first and second spark gaps are located at different axial positions and can fire independently of one another. A method of assembling the spark plug is also disclosed.

26 Claims, 1 Drawing Sheet

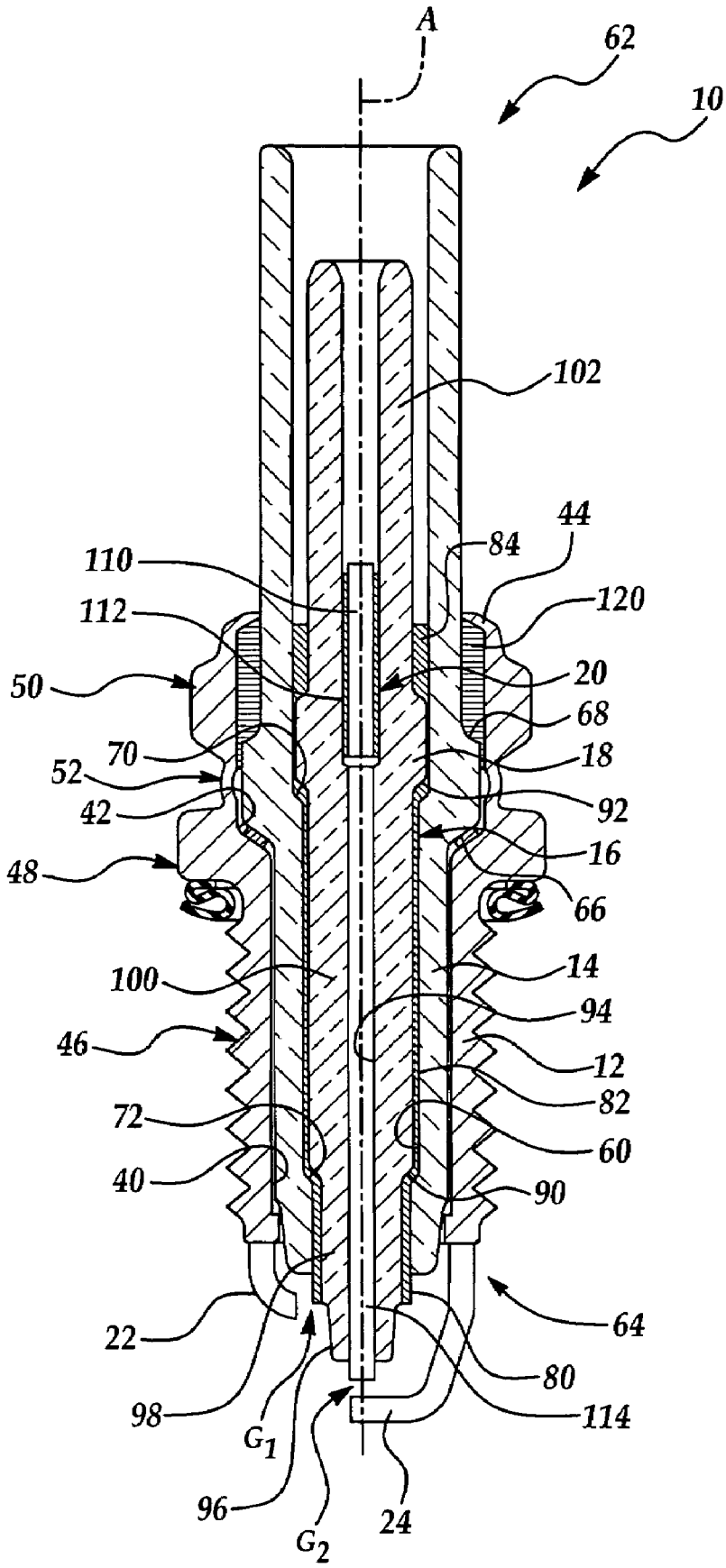
A
62
10
102
44
84
110
120
112
20
50
68
70
18
52
92
42
16
48
66
100
14
94
46
12
82
72
60
40
90
64
22
80
98
114
$G_1$
96
24
$G_2$

COAXIAL TWIN SPARK PLUG

FIELD OF THE INVENTION

The present invention relates generally to spark plugs and, more particularly, to spark plugs having two independent spark gaps.

BACKGROUND OF THE INVENTION

Traditional spark plugs typically include a center wire assembly that longitudinally extends within an insulator axial bore and is responsible for delivering a high voltage ignition pulse from an ignition wire to a single spark gap. The center wire assembly often includes a terminal electrode located towards its upper axial end, a high temperature glass seal and/or suppressive component, and a firing electrode located towards its lower axial end such that it forms a spark gap with an opposing ground electrode.

One example of a prior art spark plug is shown in U.S. Pat. No. 2,969,500, which issued on Jan. 24, 1961 to Andert. The spark plug disclosed in this patent includes a tubular conductor enclosing an insulator and a center electrode. In operation, a distributor directs current from a high voltage coil to various spark plugs in their proper succession. The majority of the spark jumps from the tubular conductor to a ground electrode, while a certain amount also jumps from the center electrode such that it illuminates an associated lamp. The associated lamp indicates that the ignition system is in operation and is working.

Spark plugs having more than one spark gap are also known in the art and include, for instance, U.S. Pat. No. 1,165,492 issued Dec. 28, 1915 to Briggs. This patent teaches a spark plug having two parallel center electrodes extending through separate longitudinal bores in an insulator. One of the center electrodes receives a high voltage ignition pulse from a high tension magneto, while the other one receives a lower voltage ignition pulse from a coil system. One object of the Briggs' invention is to utilize the lower voltage ignition pulse during starting and the high voltage ignition pulse during normal operation.

Another example of a spark plug having more than one spark gap is seen in U.S. Pat. No. 1,229,193 issued Jun. 5, 1917 to Minogue. In that patent, the spark plug has two parallel center electrodes extending through separate longitudinal insulator bores. Each of the center electrodes is radially bent at the firing end, such that in a first embodiment they bend towards each other (solid lines), while in a second embodiment they bend away from each other (phantom lines). The first embodiment acts as a single gap spark plug as one of the electrodes is grounded via connection 15, and the second embodiment acts as a dual gap spark plug as the two electrodes are electrically isolated.

One of the difficulties with dual gap spark plugs of the types described above is that they utilize an asymmetrical insulator which can add significant cost and complexity to the manufacturing process. It is therefore a general object of this invention to provide a dual gap spark plug that permits the use of more standard-shaped insulators.

SUMMARY OF THE INVENTION

In accordance with the present invention, there is provided a spark plug comprising a shell, outer and inner insulators, a cylindrical electrode assembly located between the insulators and forming part of a first spark gap, and a center wire assembly located within the inner insulator and forming part of a second spark gap, wherein the first and second spark gaps are axially spaced from one another. Preferably, the spark plug includes first and second ground electrodes extending from the shell with the first ground electrode having an end sparking surface spaced from the sparking surface of the cylindrical electrode assembly to thereby define the first spark gap, and the second ground electrode has a side sparking surface that is spaced from a tip of the center wire assembly to thereby define the second spark gap. The cylindrical electrode assembly can be either a single or multi-piece component and preferably includes a portion that extends out of and beyond the outer insulator at the firing end of the spark plug.

In accordance with another aspect of the present invention, there is provided a spark plug comprising a shell having a central bore, outer and inner insulators, a first firing electrode located between the insulators, and a second firing electrode located within the inner insulator, wherein the insulators and firing electrodes are all coaxially aligned within the central bore of the shell. Preferably, the first firing electrode includes a sparking surface spaced from a first ground electrode to thereby define a first spark gap, and the second firing electrode includes its own sparking surface that is spaced from a second ground electrode to thereby define a second spark gap.

In accordance with another aspect of the invention, there is provided a spark plug comprising a shell, outer and inner insulators, a first firing electrode located between the insulators, a second firing electrode located within the inner insulator, a first ground electrode spaced from said first firing electrode to thereby define a first spark gap, and a second ground electrode spaced from said second firing electrode to thereby define a second spark gap, wherein the first spark gap is radially oriented and the second spark gap is axially oriented. The radially oriented spark gap can be formed using a tubular electrode as the first firing electrode, such that it includes a circumferential portion of the tubular electrode as its sparking surface.

BRIEF DESCRIPTION OF THE DRAWING

A preferred exemplary embodiment of the invention will hereinafter be described in conjunction with the appended drawing which is a cutaway view of an embodiment of the spark plug of the invention having two coaxial electrodes that form two independent spark gaps.

DETAILED DESCRIPTION OF THE PREFERRED EMBODIMENTS

With reference to the FIGURE, there is shown an embodiment 10 of the spark plug of the present invention, where the spark plug includes two spark gaps formed between two coaxial electrodes and two associated ground electrodes. Spark plug assembly 10 is intended for use in an internal combustion engine and generally includes a shell 12, an outer insulator 14, a cylindrical electrode assembly 16, an inner insulator 18, a center wire assembly 20, and ground electrodes 22, 24.

Shell 12 is a generally cylindrical metallic component that extends along axis A and includes an axial bore 40 that extends throughout its length. The particular design of the shell may vary, as is commonly known in the art, but generally includes an interior shoulder 42, a deformable lip or rim 44, a threaded section 46, a barrel section 48 and an installation feature 50 located on an exterior of the shell. Interior shoulder 42 is a circumferential ledge or rim located on the interior surface of axial bore 40 where the interior diameter of the bore changes. This shoulder engages a complimentary sized exterior shoulder of outer insulator 14 such that the insulator is prevented from axially moving downwards within the shell. Lip 44 is used to mechanically lock the shell 12 onto the outer insulator 14 after assembly of the insulator into the bore 40. Threaded section 46 is used to install spark plug 10 into a threaded hole in the cylinder head of an engine. Barrel section 48 is an increased-diameter section that helps define a compression groove 52 located between the barrel section and the installation feature. Compression groove 52 is deformed during manufacture of the plug to enhance the seal between shell 12 and outer insulator 14. Installation or mounting feature 50 can be, for example, a hex surface that permits an appropriate tool, such as a wrench, to engage the shell for installation or removal of spark plug 10. The shape, size, and particular construction of the shell may vary greatly from one design to another; hence, the shell seen in the FIGURE is provided only as an exemplary embodiment.

Outer insulator 14 is a thin, elongated component that extends along axis A and is preferably made of a non-conducting ceramic material such that it may retain cylindrical electrode assembly 16 while preventing an electrical short between that assembly and the grounded shell. Outer insulator 14 is partially located within the axial bore 40 of the shell, and generally includes an axial bore 60 extending from a first axial end 62 to a second axial end 64, as well as external shoulders 66, 68 that are located at either end of an expanded central portion of the insulator 14. The shoulders 66, 68 enable the insulator to be mechanically interlocked to the shell in a known manner by engagement of the shoulders 66, 68 with the shoulder 42 and lip 44, respectively, via a pair of annular seals. Axial bore 60 extends the entire longitudinal length of the outer insulator such that it has openings at both the first and second axial ends and includes interior shoulders 70, 72. Interior shoulders 70, 72 occur at inner diameter transitions of axial bore 60 such that they receive and support the cylindrical electrode assembly 16 and inner insulator 18.

Cylindrical electrode assembly 16 acts as an electrode and supplies a first spark gap $G_1$ with a high voltage ignition pulse that can be independent of and electrically isolated from a second high voltage ignition pulse that is supplied to a second spark gap $G_2$. Cylindrical electrode assembly 16 is generally a collection of several thin, cylindrical, electrically-conductive components that together deliver a high voltage ignition pulse from an ignition lead wire (not shown) to spark gap $G_1$. Preferably, cylindrical electrode assembly 16 is centered along axis A and includes a tubular firing electrode 80, a conductive coating 82, and a glass seal 84. Tubular firing electrode 80 is preferably a thin, sleeve-shaped component that coaxially surrounds a portion of inner insulator 18 and has a radially oriented sparking surface that together with ground electrode 22 forms spark gap $G_1$. As will be appreciated from an inspection of the FIGURE, tubular electrode 80 projects out of and beyond the outer insulator 14 along an exterior surface of the inner insulator 18, and the electrode has an exposed annular section that extends around a tapered portion 96 of the inner insulator that will be described further below. This exposed portion of the tubular electrode includes a circumferential portion adjacent the end of ground electrode 22 and it is this adjacent, circumferentially-limited portion of the exposed annular section of the tubular electrode that comprises the sparking surface of the cylindrical electrode assembly 16. Preferably, the tubular electrode 80 has an axial length between 5 mm and 10 mm, and an outer diameter between 4 mm and 8 mm. In a preferred embodiment, the tubular firing electrode is made from a nickel alloy and includes some type of precious-metal addition, such as a precious metal outer coating, a precious metal tip, or a precious metal ring, etc. Some examples of appropriate precious metal materials include iridium, platinum, and alloys thereof. Conductive coating 82 is preferably a thin, electrically-conductive material layer located between the interior surface of axial bore 60 and the exterior surface of inner insulator 18. Various suitable materials will be known to those skilled in the art. This conductive coating 82 can be applied to either or both insulators, or can simply be a unitary continuation of glass seal 84 such that glass seal 84 runs from the upper, terminal portion of the plug to the tubular electrode 80. Glass seal 84 is preferably a conductive glass seal, such as a fired-in conductive seal or a fired-in suppressor seal, that is located towards the upper axial end of cylindrical electrode assembly 16 such that it seals the area between the inner and outer insulators. This conductive glass seal 84 can be a fired-in seal, as are well known in the art, and can include carbon for EMI suppression if desired or necessary for a particular application. Furthermore, it is possible to either omit or substitute the glass seal 84 from cylindrical electrode assembly 16 with some other component known to those skilled in the art.

Although the illustrated embodiment employs a multi-sectioned cylindrical electrode assembly 16 for the first center electrode, it will be appreciated by those skilled in the art that this electrode can be constructed in other ways either as a single or multi-piece component. In any of its forms, however, this electrode 16 is preferably tubular such that it can be located between the insulators 14, 18 in coaxial alignment with the shell 12, insulators, and the center wire assembly 20.

Inner insulator 18 is an elongated ceramic insulator that at least partially resides within axial bore 60 of the outer insulator 14. The inner insulator 18 is centered along axis A and preferably includes an axial bore 94, a nose portion 98, a middle portion 100, and a terminal connection portion 102. The internal bore 94 is preferably stepped, as with axial bores 40 and 60, such that it securely receives the components of center wire assembly 20. Nose portion 98 extends out of and beyond the outer insulator 14 and includes a stepped-down exposed portion 96 which extends beyond the end of tubular firing electrode 80. Specific dimensions pertaining to the length, the width, and the taper of the nose portion will depend largely upon the specific application for which the spark plug is being used. The middle portion 100 is bounded at one end by the nose portion 98 at an exterior shoulder 90 that engages the cylindrical electrode assembly 16 at shoulder 72. This prevents the inner insulator 18 from moving downward relative to the other spark plug components. Middle portion 100 is bounded at its other end by a second shoulder 92 that is formed at an enlarged diameter section of the terminal portion 102 of the insulator. This also prevents downward movement of the insulator 18. The upper section of the terminal portion 102 has a reduced wall thickness to provide a space between it and the outer insulator 14. This space is used to accommodate glass seal 84 and to enable electrical connection to the cylindrical electrode assembly 16 by an ignition lead connector. Upward movement of this insulator is prevented by glass seal. 84 such that the insulator is mechanically locked in place between the glass seal and the cylindrical electrode assembly 16 at the interior shoulders 70, 72. The upper portion 102 extends towards the terminal end of the spark plug beyond the glass seal 84 by a distance sufficient to prevent surface discharge between the glass seal and center wire assembly 20. In embodiment shown, this upper portion 102 is recessed from the terminal end of the outer insulator 14. The middle portion 100 is generally surrounded by conductive coating 82 and is preferably uniform in diameter along its length. According to a preferred embodiment, the upper section of insulator nose 98 that is surrounded by the tubular electrode 80 has a uniform diameter along its length, and the stepped-down exposed portion 96 of the insulator nose 98 is tapered towards the firing end. Also, the middle portion 100 has a wall thickness that is greater than that of both the nose portion 98 and the upper part of the terminal portion 102.

Center wire assembly 20 feeds the second spark gap $G_2$ with a second high voltage ignition pulse that can be independent of and electrically isolated from the first high voltage ignition pulse that is carried by cylindrical electrode assembly 16. Center wire assembly 20 is designed more like a traditional center wire assembly, and generally includes a terminal electrode 110 connected to a firing electrode 114, with an optional glass seal 112 generally surrounding the terminal electrode. All of the components of the center wire assembly are centered along axis A and coaxial with the inner and outer insulators, the cylindrical electrode assembly, and the shell. Terminal electrode 110 is preferably an elongated rod made from a high-temperature material, such as a nickel-based alloy like Inconel™, and sits atop an expanded portion of the top of firing electrode 114. Glass seal 112 can be a fired-in seal (conductive or otherwise) that coaxially surrounds terminal electrode 110 such that it is located between the inner surface of axial bore 94 and the outer surface of the terminal electrode. The firing electrode 114 can be constructed from Inconel™ or any other suitable metal or metal alloy, and can be a cladded electrode having a core made from copper or other material that exhibits a high thermal conductivity. The firing electrode is preferably a long, cylindrical component having an enlarged head at an upper axial end and a firing tip at a lower axial end. The enlarged head is designed to rest upon an interior shoulder or ledge of the inner insulator bore 94, and helps mechanically lock the electrode in place. The firing tip includes a firing surface that, if necessary or desirable for a particular application, can be affixed with a precious metal tip, rivet, or other component that increases the durability of the electrode. As noted above, any of a number of different precious metal materials can be used, including iridium, platinum, or alloys thereof. Similarly, the ground electrodes could also be provided with a precious metal sparking surface.

The first ground electrode 22 extends downward from an axial end of shell 12 and then bends inward, such that spark gap $G_1$ is actually formed between an end surface of ground electrode 22 and a circumferential portion of the outer surface of the axial end of tubular firing electrode 80. Thus, ground electrode 22 is radially separated from the tubular firing electrode such that the first spark gap $G_1$ is formed as a radial spark gap, meaning that the spark moves primarily in a radial direction relative to axis A when jumping between the sparking surfaces. Preferably, ground electrode 22 extends an axial distance of between 0 mm and 4 mm. A second ground electrode 24 also downwardly extends from an axial end of shell 12, preferably for an axial length of between 6 mm and 10 mm. Ground electrode 24 also extends from the same axial end of shell 12 and is bent to define the second spark gap $G_2$ as being between a side surface of ground electrode 24 and an end surface of firing electrode 114. The second spark gap is an axial spark gap, meaning that the spark moves primarily in the axial direction as it jumps between the sparking surfaces. The ground electrode 24 can be radially spaced from tubular firing electrode 80 by a distance sufficient to prevent an undesired spark in that area; a preferable radial spacing is at least 110% of the spark gap $G_1$. The axial separation of spark gaps $G_1$ and $G_2$ can be selected as desired for a particular application, but preferably are separated axially by a distance of between 2 mm and 10 mm.

When used for applications requiring standard spark plug thread diameters, such as 12 mm, 14 mm, or 18 mm thread diameters, the ceramic thickness of the inner and outer insulators should be chosen in conjunction with the center wire diameter and cylindrical electrode 16 thickness such that each ceramic has sufficient thickness to avoid cracking of the insulator during its intended service life. As is known, cracking can occur under the stress of tensile forces imparted on the ceramic as a result of tightening of the shell during installation into an engine. For 12 mm and 14 mm plugs, the ceramic thickness in the region of the barrel 48 and threads 46 of the shell can be in the range of 1.2 mm to 2.5 mm for each of the two insulators 14 and 18. For an 18 mm plug, the these dimensions can be 1.2 mm to 4 mm for each of the two insulators 14 and 18.

Each of the components of the spark plug 10 can be manufactured using known techniques and materials. Once the shell, insulators, and center wire assembly have been made, assembly of these components can be carried out via a multi-step process that begins with the center wire 20 which is assembled into the inner insulator 18. Glass powder is then inserted and compacted in place around the terminal electrode 110 and the insulator and center wire assembly are then heated in an oven to a temperature sufficient to melt and fuse the glass powder. The inner insulator and center wire subassembly is then cooled. Next, the conductive coating 82 is applied to the exterior surface of the middle portion 100 of the inner insulator 18 and all the way up to the narrowed section of its terminal portion 102. The tubular electrode 82 can be made with a flared end so that it can then be placed into the outer insulator 14 and slid down until the flared end of the electrode engages the shoulder 72. Thereafter, the inner insulator and center wire subassembly is placed into the outer insulator 14 so that the conductive coating 82 engages and makes electrical contact with the flared end of the tubular insulator 80. Conductive glass seal 84 is then made in the same general manner as described above for glass seal 112. The final step is insertion of the assembled insulators and center electrodes into the shell which can be done in a conventional manner with the insulator/center wire subassembly being inserted into the terminal end of the shell bore 40 using an annular seal 120 at both shoulders 66, 68, and then either cold or hot forming deformation of the shell to bend the lip 44 over and deform the compression groove 52 to lock the shell in place on the insulator 14. Preferably, the ground electrodes 22, 24 are welded, by laser, resistance, or any other type of appropriate technique, to a lower axial end of shell 12 prior to final assembly of the insulator and center wires into the shell. The two ground electrodes can be angularly offset from each other by 180° as shown, or can be at other relative positions, as desired.

It should be noted that the particular sequence described above is only one of many for assembling spark plug 10 of the present invention. For instance, ground electrodes 22, 24 could be affixed to the shell at any time during assembly of the spark plug, and the two glass seals 84, 112 could be fired-in place at the same time. Other changes to these assembly steps will become apparent to those or ordinary skill in the art.

In operation, a vehicle ignition system provides first and second high voltage ignition pulses to spark plug 10 via one or more ignition lead wires, wherein the first and second high voltage pulses can be independent of each other. The ignition lead wire(s) are coupled to the spark plug by a boot or other fitting that slips over top of the upper axial end of inner insulator 102, namely the terminal connection portion 102. The boot or fitting has an outer contact (not shown) that is electrically coupled to glass seal 84, and an inner contact (not shown) that is coupled to terminal electrode 110. The first ignition pulse is sent from the ignition system to spark gap $G_1$ via the cylindrical electrode assembly 16, while the second ignition pulse is sent from the ignition system to spark gap $G_2$ via the center wire assembly 20. In both cases, the ignition pulses arc across the respective spark gaps to initiate and/or sustain the combustion process. Various uses for these two, independent spark gaps will be known to those skilled in the art. For example, the first spark gap $G_1$ could be provided with a higher voltage spark to initiate combustion, followed by a longer duration, lower voltage spark across the second gap $G_2$ to help sustain the combustion. In this regard, different gap spacings could be provided for the two spark gaps. Also, the timing and sequencing of sparks across the two gaps can be selected or varied according to the needs of a particular application.

It will therefore be apparent that there has been provided in accordance with the present invention a spark plug assembly having a cylindrical electrode assembly and a center wire assembly that help form two independent spark gaps, which achieves the aims and advantages specified herein. It will, of course, be understood that the foregoing description is of a preferred exemplary embodiment of the invention and that the invention is not limited to the specific embodiment shown. For example, the spark plug assembly could include more than two spark gaps, in which case additional positive and/or ground electrodes would likely be needed. Various changes and modifications are intended to be within the scope of the present invention.

The invention claimed is:

1. A spark plug for use in an engine, comprising:

a shell having an axial bore;

an outer insulator having an axial bore and being at least partially located within said shell axial bore;

an inner insulator having an axial bore and being at least partially located within said outer insulator axial bore;

a cylindrical electrode assembly at least partially located between said outer and inner insulators and forming part of a first spark gap;

a center wire assembly at least partially located within said inner insulator axial bore and forming part of a second spark gap;

wherein said first and second spark gaps are axially spaced from one another; and wherein said spark plug further includes a first ground electrode forming said first spark gap with said cylindrical electrode assembly, and a second ground electrode forming said second spark gap with said center wire assembly.

2. The spark plug of claim 1, wherein said cylindrical electrode assembly at least partially surrounds said inner insulator and includes a radially oriented sparking surface.

3. The spark plug of claim 2, wherein said first spark gap is formed between said radially oriented sparking surface and an end surface of said first ground electrode, whereby said first spark gap is a radial spark gap.

4. The spark plug of claim 1, wherein said center wire assembly includes an axially oriented sparking surface.

5. The spark plug of claim 4, wherein said center wire assembly comprises an elongated firing electrode and a terminal electrode.

6. The spark plug of claim 4, wherein said second spark gap is formed between said axially oriented sparking surface and a side surface of said second ground electrode, whereby said second spark gap is an axial spark gap.

7. The spark plug of claim 1, wherein said cylindrical electrode assembly is electrically isolated from said center wire assembly.

8. A spark plug for use in an engine, comprising:

a shell having an axial bore;

an outer insulator having an axial bore and being at least partially located within said shell axial bore;

an inner insulator having an axial bore and being at least partially located within said outer insulator axial bore;

a cylindrical electrode assembly at least partially located between said outer and inner insulators and forming part of a first spark gap;

a center wire assembly at least partially located within said inner insulator axial bore and forming part of a second spark gap;

said first and second spark gaps are axially spaced from one another;

said cylindrical electrode assembly at least partially surrounds said inner insulator and includes a radially oriented sparking surface; and wherein said cylindrical electrode assembly comprises a tubular firing electrode, a conductive coating, and a conductive glass seal electrically connected together in series.

9. The spark plug of claim 8, wherein said conductive coating is connected at one end to said tubular firing electrode and is connected at another end to said conductive glass seal.

10. The spark plug of claim 8, wherein said tubular firing electrode has an axial length between 5 mm and 10 mm and an outer diameter between 4 mm and 8 mm.

11. The spark plug of claim 8, wherein said inner insulator includes an insulator nose portion having a first section that has a uniform diameter along its length and a second portion that is tapered toward a firing end of said spark plug, and wherein said tubular firing electrode generally surrounds said first section of said nose portion.

12. A spark plug for use in an engine, comprising:

a shell having an axial bore;

an outer insulator having an axial bore and being at least partially located within said shell axial bore;

an inner insulator having an axial bore and being at least partially located within said outer insulator axial bore;

a cylindrical electrode assembly at least partially located between said outer and inner insulators and forming part of a first spark gap;

a center wire assembly at least partially located within said inner insulator axial bore and forming part of a second spark gap;

said first and second spark gaps are axially spaced from one another;

said cylindrical electrode assembly at least partially surrounds said inner insulator and includes a radially oriented sparking surface; and wherein said spark plug further includes a first ground electrode extending from an axial end of said shell to form said first spark gap, and a second ground electrode extending from said shell axial end to form said second spark gap.

13. The spark plug of claim 12, wherein said first ground electrode extends an axial distance of between 0 mm and 4 mm and said second ground electrode extends an axial distance of between 6 mm and 10 mm.

14. The spark plug of claim 13, wherein said second ground electrode is radially spaced from said cylindrical electrode assembly by a radial distance that is at least 110% of the first spark gap.

15. A spark plug for use in an engine, comprising:

a shell having an axial bore;

an outer insulator having an axial bore and being at least partially located within said shell axial bore;

an inner insulator having an axial bore and being at least partially located within said outer insulator axial bore;

a cylindrical electrode assembly at least partially located between said outer and inner insulators and forming part of a first spark gap;

a center wire assembly at least partially located within said inner insulator axial bore and forming part of a second spark gap;

said first and second spark gaps are axially spaced from one another;

said cylindrical electrode assembly at least partially surrounds said inner insulator and includes a radially oriented sparking surface; and wherein said axially spacing between said first and second spark gaps is between 2 mm and 10 mm.

16. A spark plug for use in an engine, comprising:

a shell having a central bore;

a first insulator at least partially located within said shell;

a second insulator at least partially located within said first insulator;

a first firing electrode at least partially located between said insulators, said first firing electrode including a sparking surface of a first spark gap;

a second firing electrode extending through said second insulator, said second firing electrode including a sparking surface of a second spark gap;

wherein said first insulator, second insulator, first firing electrode, and second firing electrode are all coaxially aligned within said central bore of said shell, and first and second ground electrodes each extending from an axial end of said shell, said first ground electrode having an end surface that forms said first spark gap with said sparking surface of said first firing electrode, and said second ground electrode having a side surface that forms said second spark gap with said sparking surface of said second firing electrode.

17. The spark plug of claim 16, wherein said first firing electrode comprises a tubular electrode and said sparking surface of said first firing electrode is an outer circumferential portion of said tubular electrode.

18. The spark plug of claim 16, wherein said first spark gap is a radial spark gap and said second spark gap is an axial spark gap.

19. A spark plug for use in an engine, comprising:

a shell having a central bore;

a first insulator at least partially located within said shell;

a second insulator at least partially located within said first insulator;

a first firing electrode at least partially located between said insulators, said first firing electrode including a sparking surface of a first spark gap;

a second firing electrode extending through said second insulator, said second firing electrode including a sparking surface of a second spark gap;

a first ground electrode extending from said shell, said first ground electrode and said first firing electrode being spaced from each other such that they define a radial spark gap; and a second ground electrode extending from said shell, said second ground electrode and said second firing electrode being spaced from each other such that they define an axial spark gap.

20. The spark plug of claim 19, wherein said second insulator extends axially out of an beyond said first insulator and wherein said first firing electrode extends axially out of an beyond said first insulator along an outer surface of said second insulator.

21. The spark plug of claim 20, wherein said first firing electrode comprises a tubular electrode.

22. The spark plug of claim 19, wherein, said first ground electrode has an end surface that forms said first spark gap with a sparking surface of said first firing electrode, and said second ground electrode has a side surface that forms said second spark gap with a sparking surface of said second firing electrode.

23. The spark plug of claim 19, wherein said first insulator, second insulator, first firing electrode, and second firing electrode are all coaxially aligned within said central bore of said shell.

24. A spark plug for use in an engine, comprising:

a shell having a central bore extending along a central axis;

an outer insulator having a central bore and being at least partially located within said shell, said outer insulator extending from a terminal end of said spark plug to a firing end of said spark plug;

an inner insulator having a central bore and being at least partially located within said central bore of said outer insulator, said inner insulator projecting out of and beyond said outer insulator at said firing end;

a cylindrical electrode assembly at least partially located between said insulators and projecting out of and beyond said outer insulator along an exterior surface of said inner insulator at said firing end, said cylindrical electrode assembly having at said firing end an exposed annular section that includes a sparking surface of a first spark gap;

a center wire assembly extending through said central bore of said inner insulator and including a sparking surface of a second spark gap, wherein said shell, insulators, cylindrical electrode assembly, and center wire assembly are all coaxially aligned along the central axis;

a first ground electrode extending from said shell at said firing end of said spark plug, said first ground electrode having a sparking surface disposed radially outwardly of said sparking surface of said cylindrical electrode assembly, whereby said first spark gap is a radial spark gap;

a second ground electrode extending from said shell at said firing end of said spark plug, said second ground electrode having a sparking surface axially spaced from said sparking surface of said cylindrical electrode assembly, whereby said second spark gap is an axial spark gap;

wherein said cylindrical electrode assembly and said center wire assembly are recessed from both said inner and outer insulators at said terminal end of said spark plug.

25. The spark plug of claim 24, wherein said inner insulator is recessed within said central bore of said outer insulator at said terminal end.

26. The spark plug of claim 24, wherein said inner insulator includes an exposed tapered section extending axially between said first and second spark gaps.

* * * * *